US007644877B2

(12) United States Patent
Drechsel

(10) Patent No.: US 7,644,877 B2
(45) **Date of Patent: *Jan. 12, 2010**

(54) DIFFUSER DEVICE

(76) Inventor: Arno Drechsel, 4 Marcherstrasse 5A, Lienz (AT) 9900

( * ) Notice: Subject to any disclaimer, the term of this patent is extended or adjusted under 35 U.S.C. 154(b) by 0 days.

This patent is subject to a terminal disclaimer.

(21) Appl. No.: 11/914,754

(22) PCT Filed: May 17, 2006

(86) PCT No.: PCT/IB2006/051564

§ 371 (c)(1),
(2), (4) Date: Nov. 22, 2007

(87) PCT Pub. No.: WO2006/126146

PCT Pub. Date: Nov. 30, 2006

(65) Prior Publication Data

US 2008/0191058 A1 Aug. 14, 2008

(30) Foreign Application Priority Data

May 24, 2005 (IT) ..... VI2005A0155

(51) Int. Cl.
*B05B 1/26* (2006.01)
*B05B 3/02* (2006.01)

(52) U.S. Cl. ..... 239/516; 239/498; 239/505; 239/512; 239/391; 239/222.11

(58) Field of Classification Search ..... 239/498, 239/505, 391, 222.11, 600, 512–515
See application file for complete search history.

(56) References Cited

U.S. PATENT DOCUMENTS

| | | | | |
|---|---|---|---|---|
| 5,224,653 | A * | 7/1993 | Nelson et al. | 239/222.17 |
| 5,372,307 | A * | 12/1994 | Sesser | 239/210 |
| 5,415,348 | A * | 5/1995 | Nelson | 239/71 |
| 5,439,174 | A * | 8/1995 | Sweet | 239/222.17 |
| 5,588,595 | A * | 12/1996 | Sweet et al. | 239/222.17 |
| 5,671,885 | A * | 9/1997 | Davisson | 239/222.17 |
| 5,762,269 | A * | 6/1998 | Sweet | 239/71 |
| 5,971,297 | A * | 10/1999 | Sesser | 239/222.21 |
| 6,382,525 | B1 * | 5/2002 | Santiesteban et al. | 239/222.11 |
| 6,811,098 | B2 * | 11/2004 | Drechsel | 239/498 |
| 2004/0104287 | A1 | 6/2004 | Drechsel | |

* cited by examiner

*Primary Examiner*—Len Tran
*Assistant Examiner*—James S Hogan
(74) *Attorney, Agent, or Firm*—Themis Law

(57) ABSTRACT

This invention finds application in the field of liquid distributing devices, and more particularly relates to a sprinkler head device, for example for use in sprinkler systems for distributing liquids or the like. The device comprises a support body to be removably coupled to a sleeve for connection to an external liquid supply line, a convergent nozzle between the body and the sleeve, and a diverter member downstream from the nozzle for diverting flow and sprinkling fluid out. The device further includes main connection means for removably attaching the nozzle to the support body while preventing any accidental separation thereof upon mutual coupling and uncoupling of the sleeve to the body, thereby allowing fast and easy periodic replacement of the nozzle.

7 Claims, 4 Drawing Sheets

PRIOR ART

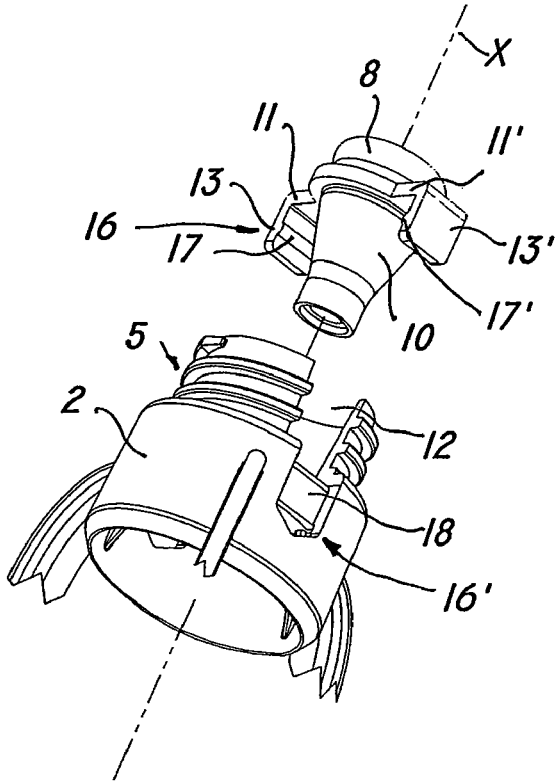
FIG. 3
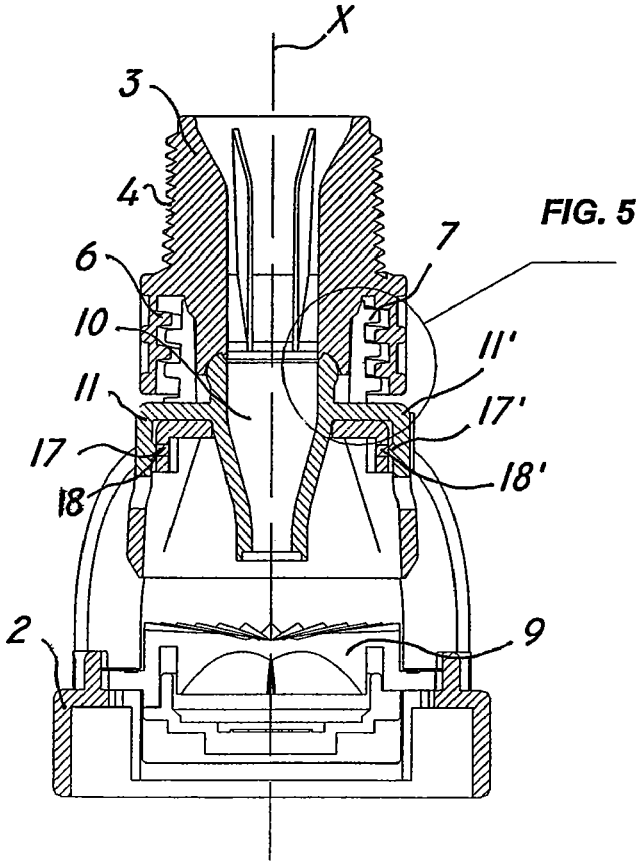
FIG. 5
FIG. 4

DIFFUSER DEVICE

FIELD OF THE INVENTION

This invention finds application in the field of liquid distributing devices, and particularly relates to a diffuser device, particularly for sprinkler plants for distributing liquids or similar fluids.

BACKGROUND OF THE INVENTION

Liquid diffuser devices are known to be particularly used in agriculture for conveying a unidirectional water flow into a nozzle and direct it to a plate which distributes it in a plurality of directions.

A diffuser device head as described above is known from international application WO2004/050258, on which the preamble of claim 1 is based.

As shown in FIG. 1, this prior art device has a partly hollow central body C, which may be connected to a liquid feed line by means of a connecting sleeve M. Liquid, whose flow direction is substantially coincident with the axis X' of the device, passes through the sleeve M and is conveyed into a convergent nozzle U, interposed between the central body C and the sleeve M. Liquid is first accelerated in the nozzle U and then directed to a deflector member, downstream of the nozzle U, which member is composed of the plates D and D', and is adapted to divert flow to a substantially transverse direction, to disperse it outward.

The nozzle U, which may have different diameters according to desired flow rates, and has to be periodically replaced as needed, is coupled to the sleeve M by snap connection means S, which are designed to hold the nozzle U in an axially locked position with respect to the sleeve M, upon mounting the latter on the central body C or dismounting it therefrom.

In practice, this prior art device has certain recognized drawbacks.

When operating in contaminated environments, with high content of dust and earth, the recess of the snap means S fills up with foreign matter, and is no longer able to effectively hold the nozzle U in position. As a result, undue efforts are required for removing and remounting the various parts, which makes nozzle replacement difficult.

Deterioration of the nozzle and sleeve connection also causes accidental disengagement of the nozzle. As the sleeve is screwed onto the central body, gravity force tends to cause removal of a badly connected nozzle, which is irremediably lost in the environment.

SUMMARY OF THE INVENTION

The object of the present invention is to overcome the above drawbacks, by providing a diffuser device that is highly efficient and relatively cost-effective.

A particular object is to provide a device that allows quick and easy replacement of the nozzle.

A further object is to provide a device that prevents any accidental separation between the nozzle and the support body.

This and other objects, as better explained hereafter, are fulfilled by a diffuser device according to claim 1, which comprises a support body that is at least partly hollow and defines a longitudinal axis, a connection sleeve for connecting to an external liquid feed line, which sleeve is designed to be removably coupled to said support body, a convergent nozzle for accelerating liquid which nozzle is interposed between said support body and said sleeve, a deflector member located in said support body downstream of said nozzle, for diverting the flow so as to distribute the fluid outward.

According to the invention, the device comprises primary connection means for removably attaching the nozzle to the support body.

Thanks to this configuration, the device of the invention prevents any accidental separation between the nozzle and the support body as the sleeve and the body are mutually coupled. This will allow periodic replacement of the nozzle to be performed in a simple and safe manner, without causing the unsteady connection problem of prior art.

Advantageously, the primary connection means may include at least one projection on one of said support body and said nozzle, which projection is designed to be engaged in a recess or receptacle formed on the other of said support body and said nozzle.

Thanks to these technical features, a firm connection between the nozzle and the support body will be obtained.

BRIEF DESCRIPTION OF THE DRAWINGS

Further features and advantages of the invention will be more apparent from the detailed description of a preferred, non-exclusive embodiment of a device according to the invention, which is described as a non-limiting example with the help of the annexed drawings, in which:

FIG. 3 is an axonometric exploded view of certain details of FIG. 2;

FIG. 4 is a view of a device according to the invention in an assembled sectional view, as taken along a plane passing through its longitudinal axis;

DETAILED DESCRIPTION OF A PREFERRED EMBODIMENT

Referring to the above figures, the device of the invention, generally designated by numeral 1, may be advantageously used for irrigation systems in agriculture or other industries, e.g. in the mining industry for dust suppression and for cooling potentially self-igniting materials.

Figure 1:
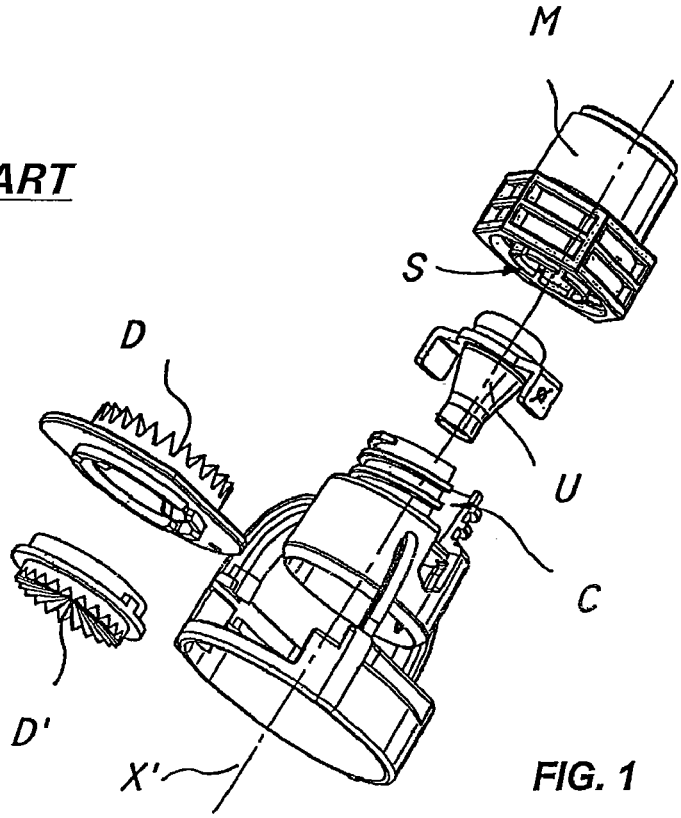
FIG. 1 is an axonometric exploded view of a prior art device.
Figure 2:
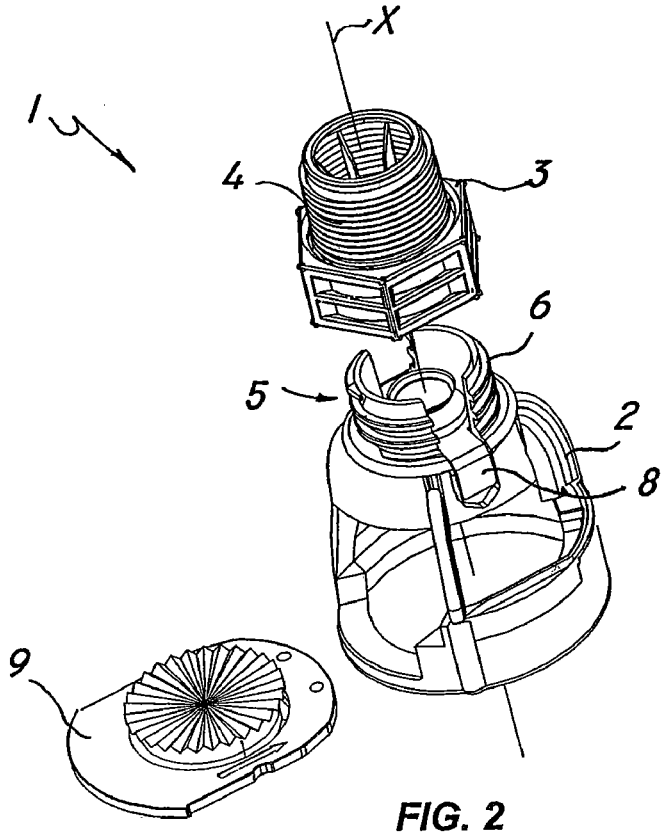
FIG. 2 is an axonometric exploded view of a device according to the invention.

As shown in FIG. 1 and 2, the device 1 essentially comprises a partly hollow support body 2 defining a longitudinal axis X, which may be removably coupled to a sleeve 3 for connection thereof to an external liquid feed line, the latter being known per se and not shown.

To this end, the sleeve 3 has an externally threaded portion 4 for meshing with a corresponding internally threaded portion of the liquid feed line. Alternatively, the sleeve 3 may have other means for connection to the liquid feed line, such as a nut and locknut assembly or a male-female connection. Liquid from the feed line flows into the sleeve 3, which has a convergent inner profile, and is further directed downstream of the body 2.

The latter has an upper portion for attachment to the sleeve 3. To this purpose, as particularly shown in FIG. 4, the portion 5 has threads 6 designed to be inserted in corresponding internal threads on the sleeve 3.

A convergent nozzle 8 is interposed between the support body 2 and the sleeve 3, to accelerate the liquid passing through the body 2 and direct it against a downstream deflector member 9 so as to divert the flow and disperse the liquid outward in a plurality of directions. Particularly, the deflector member 9 may be configured in accordance with the teachings of the international patent WO2004/050258. As is known, the nozzle 8 may have different diameters and tapers according to the specific liquid distribution needs.

As particularly shown in FIG. 3, the nozzle 8 has a substantially frustoconical longitudinal portion 10, having two transverse extensions 11 designed to be slideably inserted in corresponding longitudinal slots 12 formed on the connecting portion 5 of the body 2. As a consequence the highest stability in the operating position of the nozzle 8 is ensured.

Further, the extensions 11 have tabs 13 substantially parallel to the axis X, which may be designed, for example, to hold a mark or sign indicating the type and/or size of the nozzle 8, even when the device 1 is in the assembled condition, or to allow the nozzle to be grasped for replacement.

Figure 5:
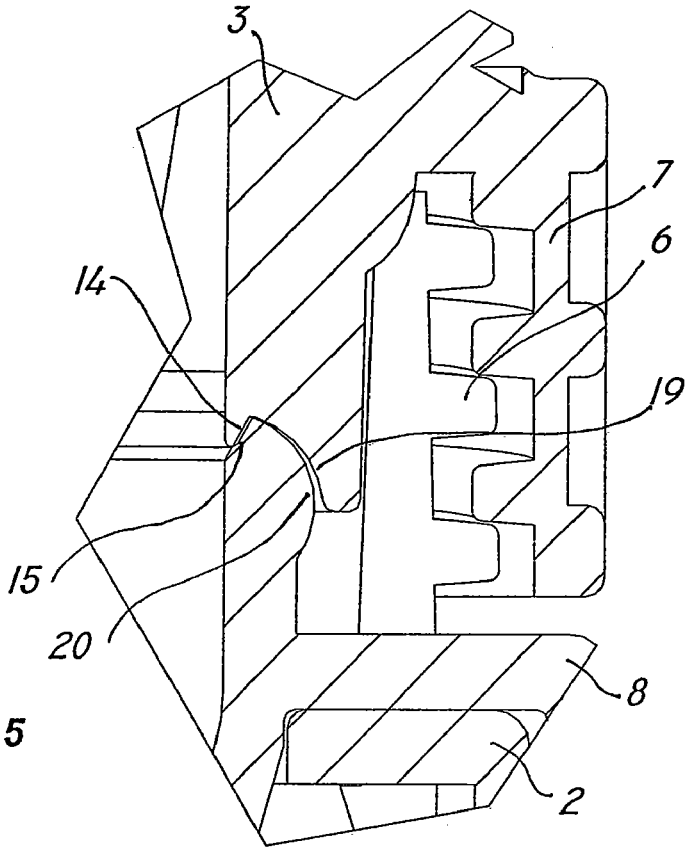
FIG. 5 is an enlarged view of certain details of FIG. 4.

As particularly shown in FIG. 5, to prevent any lateral leakage of the liquid flowing from the sleeve to the nozzle 8, the sleeve 3 comprises a substantially frustoconical sealing portion 14 coaxial to the axis X, which is suitable to press against a substantially frustoconical surface 15 of the nozzle 8. With the purpose to provide optimized fit and the most effective sealing action, the portion 14 and the surface 15 have substantially equal taper angles.

A peculiar feature of the invention is that the device 1 has primary connection means 16 for removably attaching the nozzle 8 to the body 2.

As particularly shown in FIGS. 3 and 4, the means 16 consist of a projection 17 on each of the extensions 11 of the nozzle 8, for engagement in a corresponding seat 18 in the body. It is to be understood that a kinematically inverted connection may be also provided, with the projection 17 formed on the nozzle 8 and the seat 18 formed on the body 2, without departing from the scope of the invention. Also, as an alternative to the projection 17—recess 18 connection, a male-female, screw-nut connection or the like, may be provided Nozzle 8 replacement may also occur by simply unscrewing the sleeve 3 from the body 2, grasping its tabs 13 and sliding it off upwards along the slots 12, positioning a new nozzle by slideably introducing the extensions 11 in the slots, and rescrewing the sleeve 3.

Figure 6:
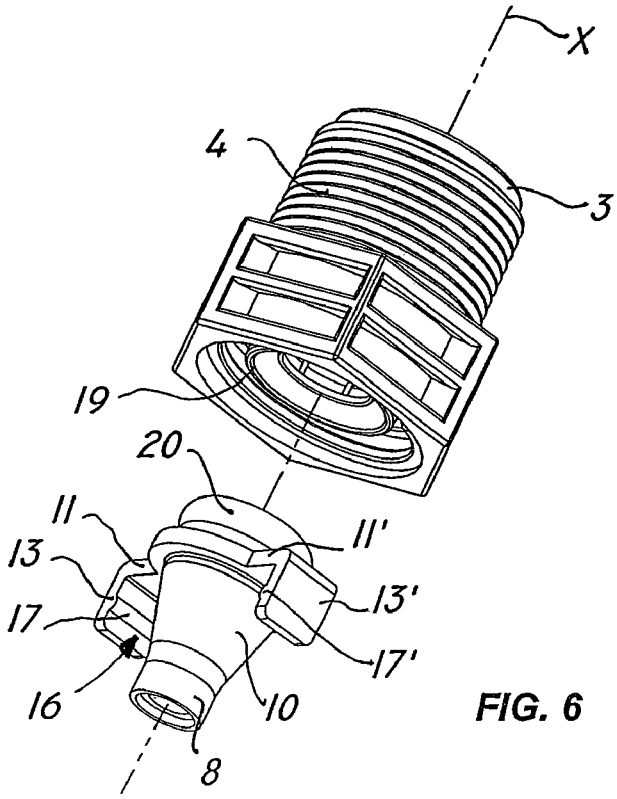
FIG. 6 is a further axonometric exploded view of certain details of FIG. 2.

As shown in FIG. 6, for the seal between the nozzle 8 and the sleeve 3 to be enhanced, the latter may have an annular portion 19, which is designed to abut against a corresponding surface 20 of the nozzle 8.

Figure 7:
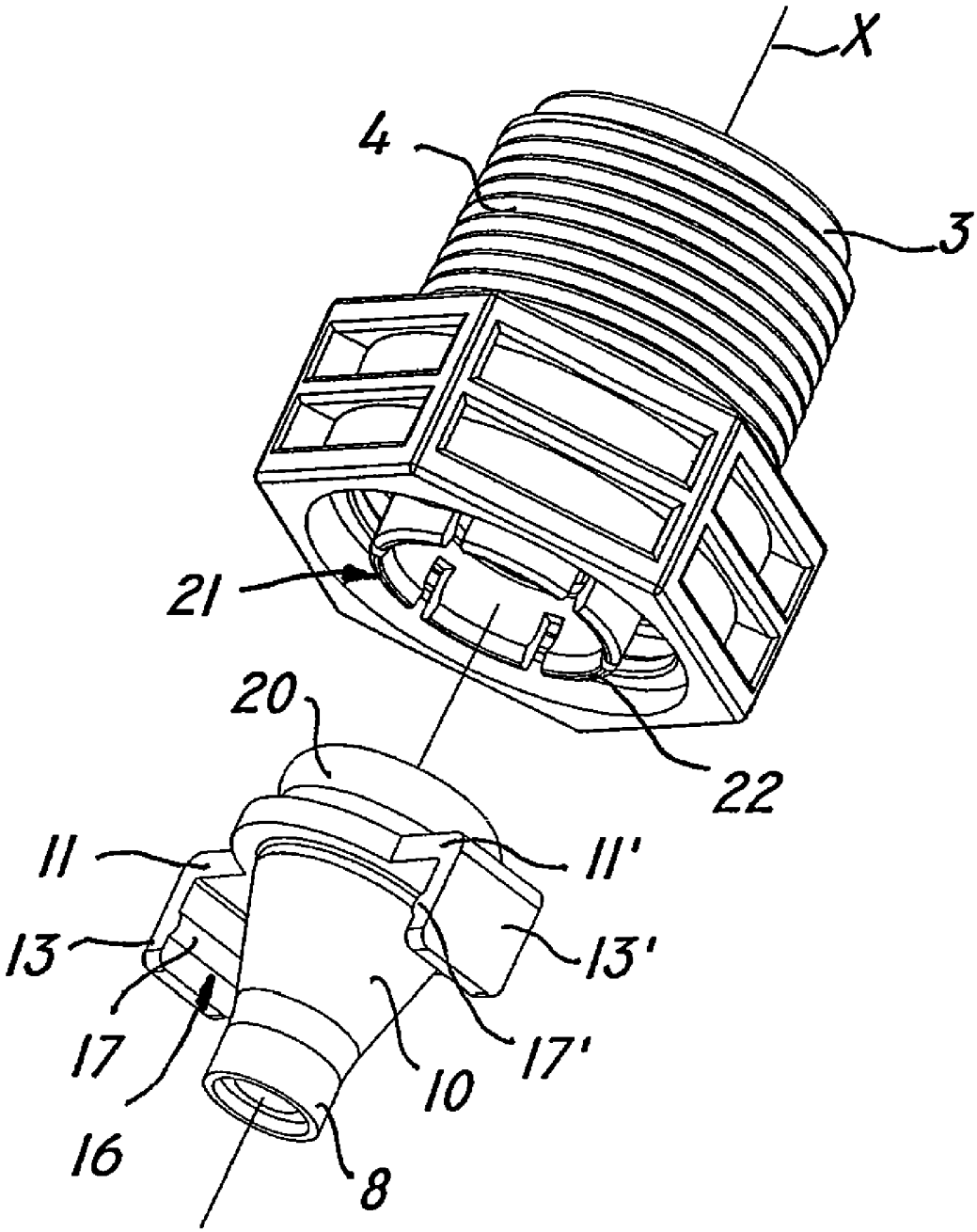
FIG. 7 is a further axonometric exploded view of certain details of FIG. 2 in another configuration.

However, a further connection may be provided, the device 1 including, according to another arrangement of the invention, secondary connection means 21 between the sleeve 2 and the nozzle 8, consisting, for instance of specially shaped projections 22 formed at the portion 19, for connection with the surface 20, as shown in FIG. 7.

In view of the foregoing it is apparent that the device according to the invention fulfills the intended objects and specifically allows a quick and easy nozzle replacement.

Thanks to the primary connection means 16 between the support body 2 and the nozzle 8, any accidental separation thereof will be prevented upon mutual coupling and uncoupling of the sleeve 3 to the body 2, thereby allowing quick and easy periodic replacement of the nozzle 8.

The device of this invention is susceptible of a number of modifications all falling within the subject matter defined in the appended claims. All the details thereof may be replaced by other technically equivalent parts, and the materials may vary depending on different needs, without departure from the scope of the invention.

While the device has been described with particular reference to the accompanying figures, the numerals referred to in the disclosure and claims are only used for the sake of a better intelligibility of the invention and shall not be intended to limit the claimed scope in any manner.

The invention claimed is:

1. A diffuser device, particularly for a sprinkler for dispersing liquids, comprising:

a support body that is at least partly hollow and defines a longitudinal axis;

a connection sleeve for connecting to an external liquid feed line, said sleeve being designed to be removably coupled to said support body;

a convergent nozzle accelerating a liquid, said nozzle being interposed between said support body and said sleeve;

a deflector member located in said support body downstream of said nozzle, said deflector member diverting liquid flow so as to distribute the liquid outwardly; and primary connection means for removably coupling said nozzle to said support body while preventing an accidental separation thereof upon mutual coupling of said sleeve with said body, the primary connection means being formed both on the support body and the nozzle, thereby allowing a fast and easy periodic replacement of the nozzle in the diffuser device, wherein said nozzle has a substantially frustoconical longitudinal portion, from which one or more transverse extensions extend radially therefrom, said transverse extensions being designed to be slideably inserted in corresponding longitudinal slots of said connection portion pertaining to said support body.

2. The diffuser device as claimed in claim 1, wherein at least one of said transverse extensions has a tab that is substantially parallel to said longitudinal axis wherein said primary connection means include at least one projection on one of said support body or on an appendage of said nozzle, said at least one projection being designed to be engaged in at least one recess or seat on the other one of said support body or on the appendage of said nozzle, wherein said support body has an upper portion for connection to said sleeve, and wherein said upper connecting portion has threads designed to engage corresponding internal threads on said sleeve.

3. The diffuser device as claimed in claim 2, wherein said at least one projection or recess is located on one of said transverse extensions.

4. The diffuser device as claimed in claim 1, further comprising secondary connection means between said sleeve and said nozzle.

5. The diffuser device as claimed in claim 1, wherein said sleeve has a substantially frustoconical sealing portion coaxial to said longitudinal axis, said sealing portion being designed to abut against a substantially frustoconical surface of said nozzle.

6. The diffuser device as claimed in claim 5, wherein said substantially frustoconical portion of said sleeve and said substantially frustoconical surface of said nozzle have substantially equal taper angles.

7. A diffuser device particularly for a sprinkler for dispersing liquids, comprising:

a support body that is at least partly hollow and defines a longitudinal axis;

a connection sleeve for connecting to an external feed line, the sleeve being configured to be removably coupled to the support body;

a convergent nozzle accelerating a liquid, the nozzle being interposed between the support body and the sleeve;

a deflector member located in the support body downstream of the nozzle, the deflector member diverting liquid flow so as to distribute the liquid outwardly; and primary connection means for removably coupling said nozzle to the support body while preventing an accidental separation thereof upon mutual coupling of the sleeve with the body, thereby allowing a fast and easy periodic replacement of the nozzle in the diffuser device, wherein the primary connection means comprise at least one projection on one of the support body or an appendage of the nozzle, the at least one projection being configured to be engaged in at least one recess or seat on the other one of the support body or the appendage of the nozzle.

* * * * *